US009437927B2

(12) United States Patent
Koga et al.

(10) Patent No.: US 9,437,927 B2
(45) Date of Patent: Sep. 6, 2016

(54) BAR ANTENNA

(71) Applicant: TOKO, INC., Tsurugashima-shi, Saitama (JP)

(72) Inventors: Akihiro Koga, Mt. Prospect, IL (US); Shin Murakami, Tsurugashima (JP); Kuniyoshi Sakurada, Tsurugashima (JP)

(73) Assignee: TOKO CO., LTD., Saitama (JP)

( * ) Notice: Subject to any disclaimer, the term of this patent is extended or adjusted under 35 U.S.C. 154(b) by 84 days.

(21) Appl. No.: 14/395,361

(22) PCT Filed: May 23, 2013

(86) PCT No.: PCT/JP2013/064389
§ 371 (c)(1),
(2) Date: Oct. 17, 2014

(87) PCT Pub. No.: WO2013/190948
PCT Pub. Date: Dec. 27, 2013

(65) Prior Publication Data

US 2015/0116171 A1 Apr. 30, 2015

(30) Foreign Application Priority Data

Jun. 21, 2012 (JP) ..... 2012-139757

(51) Int. Cl.

| | |
|---|---|
| ***H01Q 7/08*** | (2006.01) |
| ***H01Q 1/40*** | (2006.01) |
| *H01Q 1/24* | (2006.01) |
| *H01Q 1/32* | (2006.01) |

(52) U.S. Cl.
CPC ..... *H01Q 7/08* (2013.01); *H01Q 1/40* (2013.01); *H01Q 1/243* (2013.01); *H01Q 1/32* (2013.01); *H01Q 1/3291* (2013.01)

(58) Field of Classification Search
CPC ..... H01Q 7/08; H01Q 1/40
See application file for complete search history.

(56) References Cited

U.S. PATENT DOCUMENTS

| | | | | |
|---|---|---|---|---|
| 6,229,492 | B1 | 5/2001 | Lee et al. | |
| 6,603,441 | B2 * | 8/2003 | Teshima | H01Q 1/36 343/711 |
| 2002/0033777 | A1 * | 3/2002 | Maruyama | H01Q 1/241 343/713 |

(Continued)

FOREIGN PATENT DOCUMENTS

| | | |
|---|---|---|
| DE | 102005057556 A1 | 5/2007 |
| DE | 102006011086 A1 | 9/2007 |

(Continued)

OTHER PUBLICATIONS

Sep. 17, 2013 Search Report issued in International Patent Application No. PCT/JP2013/064389.

(Continued)

*Primary Examiner* — Trinh Dinh
(74) *Attorney, Agent, or Firm* — Oliff PLC

(57) ABSTRACT

A bar antenna comprises: a bar core configured to connect at least two of core pieces in series, a bobbin covering at least a portion of the bar core, a winding wound in a predetermined range of the bobbin, and a case having the bar core and the bobbin disposed therein, wherein the bar core and the bobbin are sealed by filling in the case with a potting material, and the bar core is configured to be bendable with respect to a predetermined external force at a connection portion of the at least two of core pieces.

10 Claims, 6 Drawing Sheets

(56) References Cited

U.S. PATENT DOCUMENTS

| | | | | |
|---|---|---|---|---|
| 2002/0122011 | A1 | 9/2002 | Teshima | |
| 2010/0164822 | A1* | 7/2010 | Iwasaki | H01Q 1/3241 343/788 |

FOREIGN PATENT DOCUMENTS

| | | |
|---|---|---|
| JP | Y1 36-25423 | 9/1961 |
| JP | U 61-57704 | 4/1986 |
| JP | A 8-271659 | 10/1996 |
| JP | A 2001-358522 | 12/2001 |
| JP | A 2002-512748 | 4/2002 |
| JP | A 2002-204122 | 7/2002 |
| JP | A 2002-261536 | 9/2002 |

OTHER PUBLICATIONS

Dec. 21, 2015 Search Report issued in European Patent Application No. 13806799.6.

* cited by examiner

PRIOR ART

BAR ANTENNA

TECHNICAL FIELD

The present invention is related to a bar antenna, in particular, to a bar antenna having a plurality of bar cores being divided.

BACKGROUND ART

Conventionally, as one of the parts which are in charge of communication functions, a bar antenna using a bar core whose material is a ferrite of a ferromagnetic material is widely used. However, the ferrite is formed by ceramics such as iron oxide mainly, and so there exists a drawback that the ferrite has a low impact resistance and is very brittle. In particular, if the bar core is formed to an elongated form having thin thickness, the bar core is broken easily sometimes. With regard to the bar antenna having the broken bar core, the inductance of the bar antenna decreases and the resonance frequency thereof changes, and so communication at a desired frequency cannot be made.

Therefore, means that the bar antenna itself has a flexible structure is proposed. For example, in Japanese Laid-open Patent Application Publication No. H08-271659, as illustrated in FIG. 8, a structure of a bar antenna for a radio wave clock is disclosed. In a bar antenna of a radio wave clock, as a structure of the bar antenna whose performance is not deteriorated by a damage due to impact or pressure and whose improvement in quality becomes possible, the following structure of the bar antenna is disclosed. The bar antenna 1 includes a plurality of bar cores 2, a bobbin 6 of a hollow shape made of a synthetic resin, and a winding 3 being wound on the outer periphery of the bobbin 6. A space is provided between each of the bar cores 2, a bent portion 6*a* is provided in a portion matching with the space, and the bar cores 2 are connected in a line and held in the inside of the bobbin 6. Such a structure can prevent the damage of the bar core due to impact or pressure by falling of the radio wave clock, and in an assembling process of the antenna during manufacturing, can aim to improve the reliability of the radio wave clock, and thereby reduce the cost by the structure for improving impact resistance of the antenna and by the quality assurance (refer to Abstract and FIG. 1 of Japanese Laid-open Patent Application Publication No. H08-271659). Here, the sign given to each element in this paragraph and FIG. 8 is the sign described in Japanese Laid-open Patent Application Publication No. H08-271659, and is of this paragraph only.

Further, from the standpoint of the reliability of the communication function of the bar antenna, means for protecting the bar core from external forces by the pressure or the impact has been proposed. For example, Japanese Laid-open Patent Application Publication No. 2001-358522 discloses a structure of a bar antenna, as illustrated in FIG. 9, including, as means for preventing damage to a single bar core and for increasing the reliability of the bar core, a single bar core 3 made of a thin rod-like ferromagnetic body, a bobbin 4 holding a winding being wound to the bar core 3 in an insulating state and wrapping the bar core 3, a case 5 accommodating the bar core 3 and the bobbin 4, and a potting material 6 sealing the bar core 3 and the bobbin 4 in the case 5. Such a structure can isolate the bar core 3 from the degradation factors as temperature and humidity, vibration, and the like by the potting material 6 (refer to Abstract and FIG. 1 of Japanese Laid-open Patent Application Publication No. 2001-358522). Here, the sign given to each element in this paragraph and FIG. 9 is the sign described in Japanese Laid-open Patent Application Publication No. 2001-358522, and is of this paragraph only.

However, since in the invention of Japanese Laid-open Patent Application Publication No. H08-271659, the winding is wound across a plurality of bar cores being divided, there exists a problem that the possibility of being unable to communicate at a predetermined frequency depending on the degree of deformation in the winding portion across the bar cores, that is, the bending portion cannot be excluded. Further, since in the invention of Japanese Laid-open Patent Application Publication No. H08-271659, the bobbin wrapping the single bar core is sealed in the case using the potting material, there exists a problem that the possibility that the bar core breaks in the vicinity of the center of the winding when a strong external force or an impact is applied cannot be excluded. Meanwhile, a case of adapting a remote or automatic operation in place of the manual operation by human operation of various devices that are around us is increasing. For example, in an automobile, in order to perform unlocking of the door by receiving a radio wave from a remote control device that a driver has, or to perform unlocking of the door automatically when a portable device that a driver carries approaches a certain distance, some means carries out polling for communicating even when the car is parking and consumes battery power. Further, when it is intended to extend the distance in which the communication is possible, it is brought to increase the current supplied to the antenna, and so a situation occurs that the power consumption increases and the load to the battery increases.

In order to prevent such a situation, it is desirable to use a high output antenna having a high output per one piece without increasing the power consumption. In that case, it is preferable to increase the length of the bar core. However, in the prior art described above, there is a problem that it is difficult to constitute the length of the bar core to be long, while the bar antenna has a high impact resistance and can exert the function thereof continuously even if being bent. It is because, since in the invention of Japanese Laid-open Patent Application Publication No. H08-271659, the winding is wound across a plurality of bar cores being divided, even if the length of the divided bar core is taken longer further, the possibility of being unable to communicate at a predetermined frequency depending on the degree of the deformation of the bending portion still cannot be excluded, and in the invention of Japanese Laid-open Patent Application Publication No. 2001-358522, by increasing the length of the single bar core, the impact resistance decreases and when the bar core breaks, the predictability of the break portion, furthermore, the frequency change is lowered further.

CITATION LIST

Patent Literature

Patent Literature 1: Japanese Laid-open Patent Application Publication No. H08-271659
Patent Literature 2: Japanese Laid-open Patent Application Publication No. 2001-358522

SUMMARY OF INVENTION

Technical Problem

The present invention has been made in view of the above described problems. The object of the present invention is to provide a bar antenna having a high impact resistance and capable of continuously exerting the function thereof even if the bar core is bent, and further giving a high output while satisfying these conditions.

Solution to Problem

In order to solve the above described problems, the present invention provides the following means.

(1) Provided is a bar antenna comprising: a bar core configured to connect at least two of core pieces in series; a bobbin covering at least a portion of the bar core; a winding wound in a predetermined range of the bobbin; and a case having the bar core and the bobbin disposed therein, where the bar core and the bobbin are sealed by filling in the case with a potting material, and the bar core is configured to be bendable with respect to a predetermined external force at a connection portion of the at least two of core pieces.

(2) In the bar antenna according to above described (1), the bobbin may cover substantially the entire of the bar core, and the winding may be wound on a portion corresponding to either longer core piece of the at least two of core pieces of the bobbin.

(3) In the bar antenna according to above described (1), the bobbin may cover either longer core piece of the at least two of core pieces, and the winding may be wound substantially on the entire of the bobbin.

(4) In the bar antenna according to any one of above described (1) to (3), the potting material may be a resin having a low residual stress and a low viscosity.

(5) In the bar antenna according to any one of above described (1) to (4), the winding may be wound on the bobbin by multilayered winding.

(6) In the bar antenna according to above described (1), the at least two of core pieces may comprise a first core piece and a second core piece in this order, and the first core piece may have a length longer than the second core piece, and the bobbin may cover the first core piece.

(7) In the bar antenna according to above described (1), the at least two of core pieces may comprise a first core piece, a second core piece and a third core piece in this order, and the second core piece may have a length longer than the first core piece and the third core piece, and the bobbin may cover the second core piece.

(8) In the bar antenna according to above described (1), the at least two of core pieces may comprise a first core piece, a second core piece, a third core piece and a fourth core piece in this order, and the second core piece may have a length longer than the first core piece, the third core piece and the fourth core piece, and the bobbin may cover the second core piece.

(9) In the bar antenna according to above described (1), the at least two of core pieces may comprise a first core piece, a second core piece, a third core piece, a fourth core piece and a fifth core piece in this order, and the second core piece may have a length longer than the first core piece, the third core piece, the fourth core piece and the fifth core piece, and the bobbin may cover the second core piece.

(10) In the bar antenna according to above described (1), the at least two of core pieces may comprise a first core piece, a second core piece, a third core piece, a fourth core piece and a fifth core piece in this order, and the third core piece may have a length longer than the first core piece, the second core piece, the fourth core piece and the fifth core piece, and the bobbin may cover the third core piece.

Advantageous Effects of Invention

The present invention provides a bar antenna having a high impact resistance and capable of continuously exerting the function thereof even if the bar core is bent, and further giving a high output while satisfying such conditions.

BRIEF DESCRIPTION OF DRAWINGS

FIG. 5 is a conceptual diagram illustrating a bar core, a bobbin, a winding and a printed circuit board extracted from the bar antenna according to the fourth embodiment of the present invention.

FIG. 6 is a diagram illustrating the third modification example according to the fourth embodiment of the present invention.

DESCRIPTION OF EMBODIMENTS

Hereinafter, referring to the attached drawings, embodiments of the present invention shall be described in detail. In FIG. 1 to FIG. 4, the same reference sign indicates the same part or the corresponding part. Further, the present invention, as is apparent from the following description, is not limited to these embodiments, and can be modified in various ways by those skilled in the art within the scope of the invention.

First Embodiment

Figure 1:
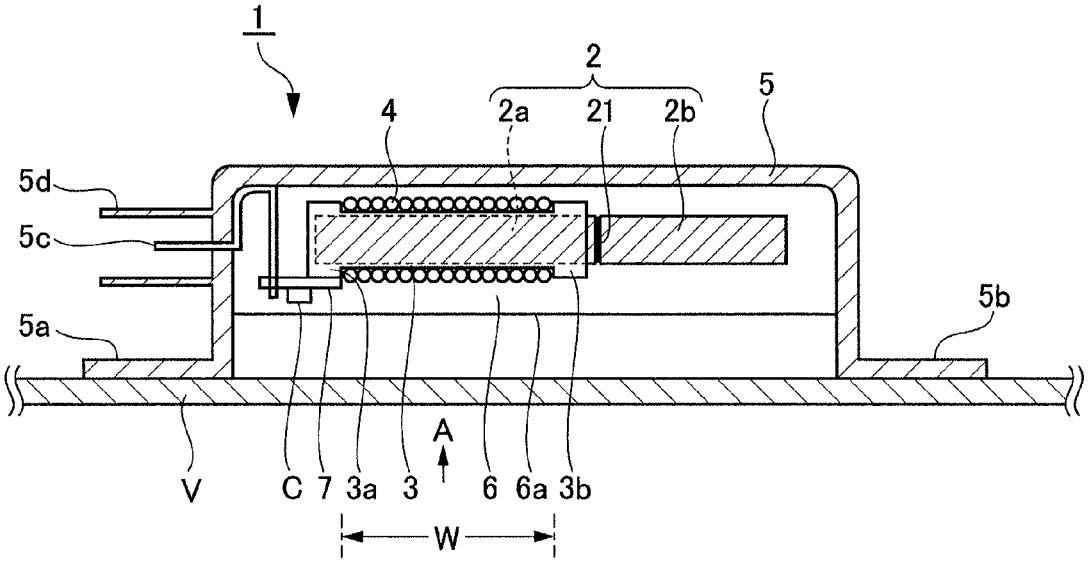
FIG. 1 is a conceptual diagram illustrating a longitudinal cross-section of a bar antenna according to the first embodiment of the present invention.
Figure 2:
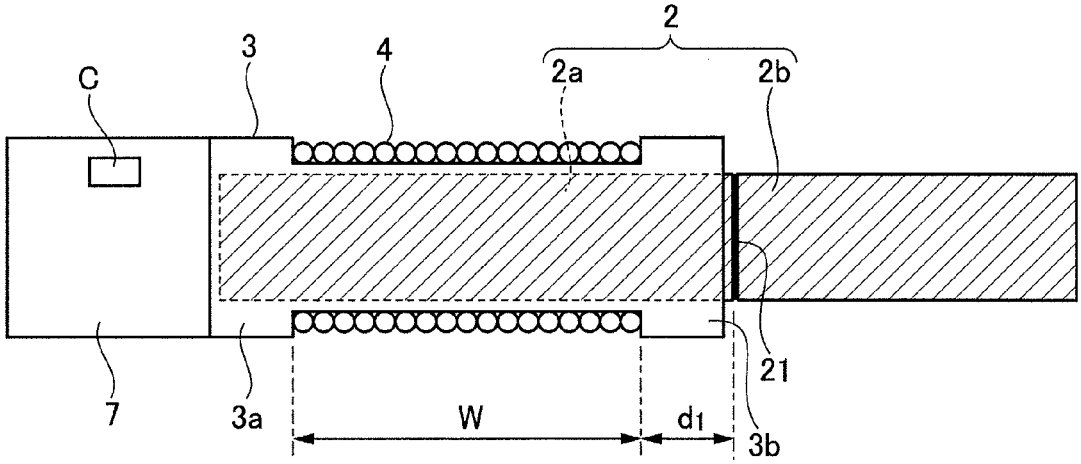
FIG. 2 is a conceptual diagram illustrating a bar core, a bobbin, a winding and a printed circuit board extracted from the bar antenna according to the first embodiment of the present invention.

FIG. 1 is a conceptual diagram illustrating a longitudinal cross-section of a bar antenna according to the first embodiment of the present invention. FIG. 2 is a conceptual diagram illustrating a bar core, a bobbin, a winding and a printed circuit board extracted from the bar antenna according to the first embodiment of the present invention, and is viewed from an arrow A side of FIG. 1.

A bar antenna 1 includes, a bar core 2 being formed by connecting in series a first core piece 2*a* and a second core piece 2*b* having a length different from the length of the first core piece, a bobbin 3 covering the first core piece 2*a* only, a winding 4 being wound over a predetermined range of the bobbin 3, a case 5 having the bar core 2 and the bobbin 3 being accommodated therein, and a potting material 6 sealing the first core piece 2*a* and the second core piece 2*b* being filled in the case 5. Here, the first core piece 2*a* and the second core piece 2*b* are connected by an adhesive, and are configured to be bendable to a predetermined external force in a connection portion 21 of the first core piece 2*a* and the second core piece 2*b*. The bar antenna 1 is mounted to a vehicle V.

Both of the first core piece 2*a* and the second core piece 2*b* is formed of a ferromagnetic body, and for example, a manganese ferrite, and the like can be used. The first core piece 2*a* and the second core piece 2*b* are connected by an adhesive. The material of the adhesive is not limited in particular, but an epoxy-based adhesive is used here. Meanwhile, in FIG. 1, both the first core piece 2*a* and the second core piece 2*b* are illustrated assuming a plate shape having a rectangular cross-sectional shape, but a circular or an ellipsoidal cross-sectional shape may be possible as far as a cross-sectional area or a volume that are required is ensured.

Note that since the longer the length of a single bar core, the less becomes the resistance to breakage and a breakage tends to occur, and the broken portion occurs in the vicinity of the center of the bar core, it is preferred that the first core piece 2*a* and the second core piece 2*b* have the same length. However, in the present embodiment since a minimum length for winding the winding 4 is required for the first core piece 2*a*, the first core piece 2*a* on which the winding 4 is wound is longer and the second core piece 2*b* on which the winding 4 is not wound is shorter. The ratio of the length of the first core piece 2*a* to the length of the second core piece 2*b* is about five to three.

The bobbin 3, in the present embodiment, covers the first core piece 2*a* only, and in the following description, this type of bobbin is referred to as a short bobbin sometimes. The bobbin 3, for example, is formed with a polybutylene terephthalate (PBT) resin which is excellent in electrical properties, heat resistance, chemical resistance, dimensional stability and moldability, and is also easy to have flame resistance. At the both ends of the bobbin 3, flanges 3*a*, 3*b* are provided, and a printed circuit board 7 being formed with a glass epoxy is attached to the flange 3*a*. A chip of a capacitor C for forming a resonant circuit is mounted, and the end portion of the winding 4 is connected to the printed circuit board 7.

The bobbin 3 can be attached to the inside of the case 5 by various means. For example, the bobbin 3 can be held in the case 5 by fitting the flanges 3*a*, 3*b* to a groove (not illustrated) being provided to the inner wall of the case 5. A pin 5*c* illustrated in FIG. 1 is a terminal for electrically connecting the printed circuit board 7 to an external antenna control circuit.

In the winding 4, the number of turns required to communicate at a target frequency are wound in one layer in a winding width W around the center of the bobbin 3. As a wire material of the winding 4, an insulated copper wire coated with a polyurethane or the like can be used appropriately. In addition, d1 is a distance between the connection portion 21 of the first core piece 2*a* and the second core piece 2*b* and the end of the winding 4.

The case 5 is an oblong box body and one side thereof in a longitudinal direction is opened, and the inside of the case 5, the bar core 2 and the bobbin 3 covering a portion of the bar core 2 are accommodated. Here, it is illustrated assuming that the case 5 is square pole having a longitudinal cross-section of a rectangular shape, but the shape is not limited to this, and as far as the bar core 2 and the bobbin 3 can be accommodated, for example, a cylinder and the like having a flat surface on the outer periphery are possible. The flat surface is, as described below, sealed with the potting material 6 being filled in the case 5. The case 5 is attached to the object V using fixing parts such as a screw or the like, so that the surface 6*a* configured with the potting material 6 faces the surface of the object V. In the case 5, one end of the pin 5*c* for electrically connecting the printed circuit board 7 to the external antenna control circuit protrudes outside the case 5, and around the other end, a plug-in 5*d* for inserting a wire harness is provided. The cases is formed with a polybutylene terephthalate (PBT) resin in the same way as the bobbin 3.

The potting material 6 is a flexible, electrically insulating material and is filled in the case 5 being accommodated with the bar core 2 and the bobbin 3 covering the bar core 2 by a method such as a vacuum injection or the like, and then is hardened. Therefore, it is preferred that the potting material 6 has a low viscosity so as to be able to fill easily, and it is preferred that the potting material 6 is of a low residual stress so that no residual stress is left on the bar core after hardening. Even if the connection portion 21 of the first core piece 2*a* and the second core piece 2*b* which is connected by an adhesive material bends due to drop impact and the connection by the adhesion breaks, the potting material 6 keeps the positional relationship of the first core piece 2*a* and the second core piece 2*b* so as not to change significantly, and functions so as to return to the original positions after the drop impact.

The potting material 6 has also a waterproof function. For example, when the bar antenna 1 is disposed to a place being exposed to the outer atmosphere in a automobile and the like, the potting material 6 prevents the rain water and the wash water from entering the case 5.

As the potting material 6, for example, an urethane resin for injection molding can be used. With filling by a vacuum injection or the like, the potting material 6 fills the whole of the gap between the bar core 2 and the bobbin 3, the gap between the bobbin 3 and the case 5, and the gap between the bar core 2 and the case 5, and covers the entire body including the first core piece 2*a* and the second core piece 2*b*. If the hardness after the hardening of the urethane resin being used for the potting material 6 is too hard, when subjected to drop impact, stress is transmitted to the first core piece 2*a* or the second core piece 2*b* which are sealed on the contrary and the first core piece 2*a* or the second core piece 2*b* breaks, and so it is preferred that the hardness of the urethane resin to be used for the potting material 6 is comparatively soft.

As described above, in the present embodiment, the bar core 2 is divided into the first core piece 2*a* and the second core piece 2*b*, they are connected by the adhesive, and the entire body is sealed with the potting material 6, and so the following effects can be achieved.

(1) By shortening the length of the two core pieces 2*a*, 2*b* comparing to a single bar core 2, the resistance to breakage of each of the core pieces is improved.

(2) When the bar antenna is subjected to impact due to drop or the like, an stress applied to each of the core pieces is reduced by bending of the connection portion 21. And it is prevented that each of the core pieces breaks at a place except the connection portion 21.

Second Embodiment

Figure 3:
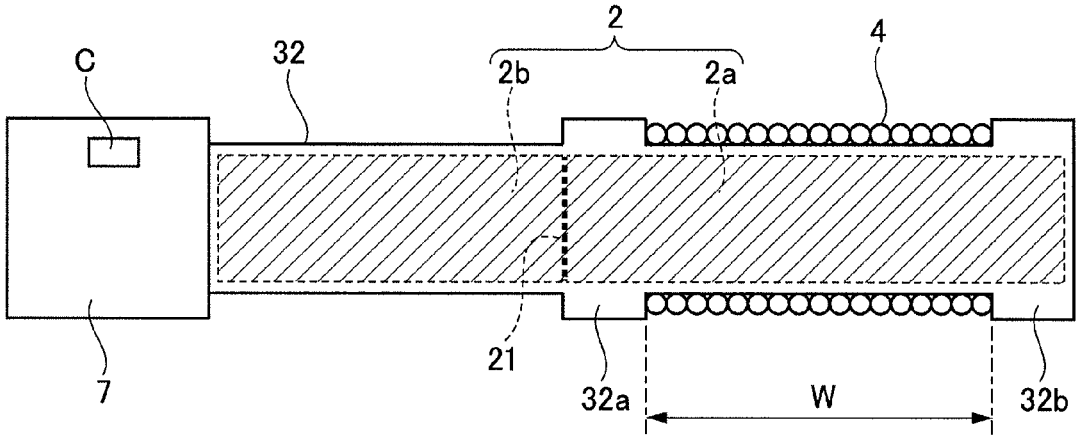
FIG. 3 is a conceptual diagram illustrating a bar core, a bobbin, a winding and a printed circuit board extracted from the bar antenna according to the second embodiment of the present invention.

FIG. 3 is a conceptual diagram illustrating a bar core, a bobbin, a winding and a printed circuit board extracted from the bar antenna according to the second embodiment of the present invention and is viewed from an arrow A side of FIG. 1. Using the element and the sign being given thereto corresponding to the first embodiment, different points shall be described. In the second embodiment, a bobbin 32 covers almost the entire body of the bar core 2, and the printed circuit board 7 is attached to its end portion in the side of the core piece 2*b*. The type of the bobbin 32 in the present embodiment, in the following description, is referred to as a long bobbin, to the short bobbin as described above, sometimes.

In the above described first embodiment, the first core piece 2*a* and the second core piece 2*b* are not accommodated in the bobbin 3 which is a short bobbin, and are exposed in the case 5. On the other hand, in the present embodiment, the first core piece 2*a* and the second core piece 2*b* are accommodated in the bobbin 3 which is a long bobbin. In the winding 4, the number of turns required to communicate at a target frequency are wound in one layer in a winding width W around a portion of the bobbin 32 covering the first core piece 2*a*. In this condition, the potting material 6 is filled into the case 5 in the same manner as in the embodiment 1.

In the present embodiment too, the bar core 2 is divided into the first core piece 2*a* and the second core piece 2*b*, they are connected by an adhesive, and the entire body is sealed with the potting material 6, and thereby the same effects as in the embodiment 1 can be achieved.

The surroundings of the first core piece and the second core piece are filled with the potting material. By the flexibility of the potting material, the drop impact is relieved and the first core piece and the second core piece are going to be returned to their original positions after the drop impact. However, since the positions of the first core piece and the second core piece are changed slightly, the resonance frequency is shifted slightly. This slight shift in frequency can be suppressed further, by placing the winding position of the winding as far as possible from the connection portion.

Third Embodiment

Figure 4:
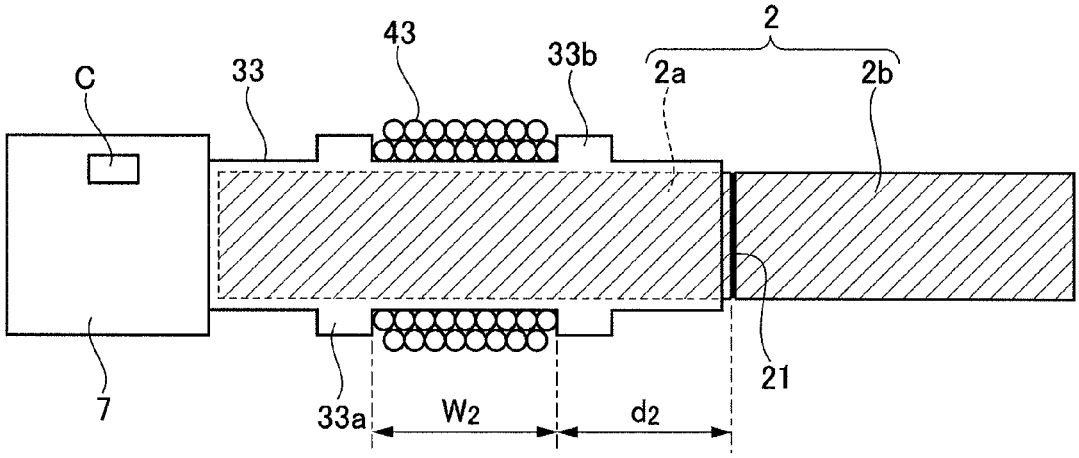
FIG. 4 is a conceptual diagram illustrating a bar core, a bobbin, a winding and a printed circuit board extracted from the bar antenna according to the third embodiment of the present invention.

FIG. 4 is a conceptual diagram illustrating a bar core, a bobbin, a winding and a printed circuit board extracted from the bar antenna according to the third embodiment of the present invention and is viewed from an arrow A side of FIG. 1. Using the element and the sign being given thereto corresponding to the first embodiment, different points shall be described. In the third embodiment, the winding is modified to a multi-layer winding.

In the present embodiment, in the winding 43, the number of turns required to communicate at a target frequency are wound in one layer in a winding width $W_2$ (<W) around the bobbin 33. Therefore, the positions of the flange 33*a* and the flange 33*b* also move the center portion of the bobbin 33.

In the present embodiment, the winding 43 is wound in a multi-layer, and the distance $d_2$ from the connection portion 21 to the winding 43 is taken longer than the first embodiment (i.e., $d_2>d_1$). By taking such a structure, even if the slight position changes of the first core piece 2*a* and the second core piece 2*b* occur, the effect of minimizing the change in the resonance frequency can be achieved.

Fourth Embodiment

In the first to the third embodiments described above, a case where the core piece forming the bar core 2 is composed of two pieces, that is, the first core piece 2*a* and the second core piece 2*b*, is illustrated, but there is no need to limit the number of the core piece to two. As described above, if for example, it is required to extend the distance in which the communication is possible, and to suppress the power consumption of the battery, the number of the core pieces may be three or more, and the length of the bar core, furthermore, the bar antenna 1 may lengthen, so that the output per piece can be increased. By doing so, the bar core has a high impact resistance, and the bar antenna can be obtained which exerts continuously the function of a bar antenna and gives high output, even if the bar core is bent.

Figure 5A:
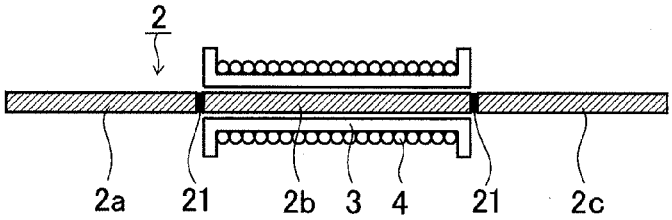
FIG. 5A represents the first modification example having three core pieces.
Figure 5B:
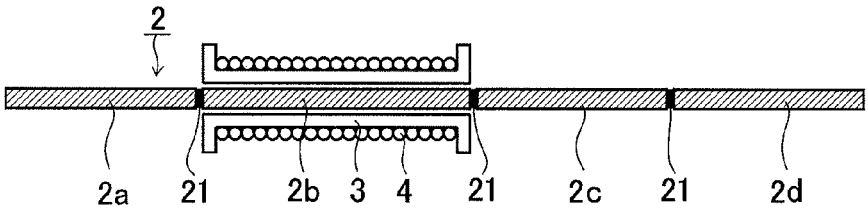
FIG. 5B represents the second modification example having four core pieces.
Figure 5C:
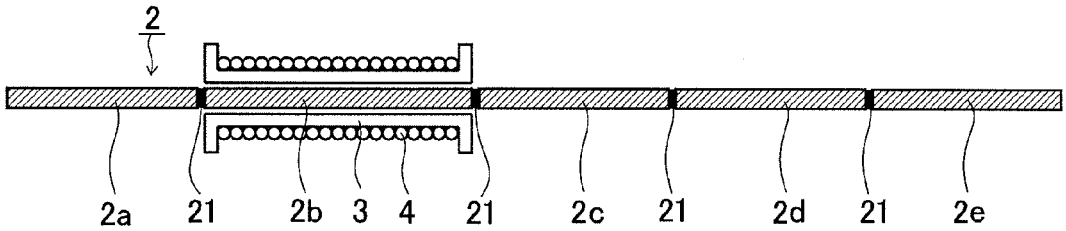
FIG. 5C represents the third modification example having five core pieces and having the second core piece from the end being covered with a bobbin.
Figure 5D:
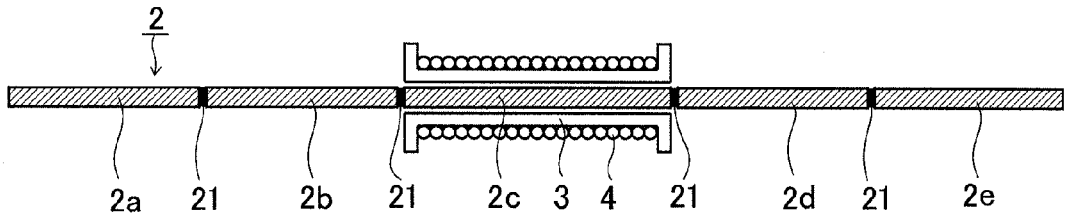
FIG. 5D represents the fourth modification example having five core pieces and having the center core piece being covered with a bobbin.

Hereinafter, as the fourth embodiment, a case where the number of the core pieces is increased and the length of the bar core 2 lengthened. FIG. 5 is a conceptual diagram illustrating a bar core, a bobbin, a winding and a printed circuit board extracted from the bar antenna according to the fourth embodiment of the present invention, FIG. 5A represents the first modification example having three core pieces, FIG. 5B represents the second modification example having four core pieces, FIG. 5C represents the third modification example having five core pieces and having the second core piece from the end being covered with a bobbin, and FIG. 5D represents the fourth modification example having five core pieces and having the center core piece being covered with a bobbin. The case 5, the potting material 6, the printed circuit board 7, and the like are provided in the approximately same manner as in the first embodiment, and so they are omitted in FIG. 5. In addition, the printed circuit board 7, in the modification examples 1 to 4, may be provided at either one end side (left end side in FIGS. 5A to 5D) or the other end side (right end side in FIGS. 5A to 5D).

In the modification example 1 of FIG. 5A, the bar core 2 is configured by three core pieces of the first core piece 2*a*, the second core piece 2*b* and a third core piece 2*c*. And the core piece 2*b* in the center has a length longer than the lengths of the first core piece 2*a* and the third core piece 2*c* in both the sides, and is covered with a bobbin 3 being wound with a winding 4. The core pieces 2*a*, 2*b*, 2*c* are connected each other by an adhesive in the same manner as in the first embodiment, and the connection portions 21 are formed bendably.

It is preferred that the connection portion 21 of the first core piece 2*a* and the second core piece 2*b*, and the connection portion 21 of the second core piece 2*b* and the third core piece 2*c* are, in the same manner as in the first to the third embodiments, are not located in the section where the winding 4 is wound. It is because in the case the connection portion 21 is located in the section where the winding 4 is wound, when the connection portion 21 is bent by an external impact, the frequency change becomes large, and the bar antenna 1 cannot exert the predetermined function as the bar antenna 1. In the fourth embodiment, as in the modification example 1, due to the existence of the first core piece 2*a* and the third core piece 2*c* being divided in the both sides of the winding 4, while the section where the winding 4 is wound is maintained, it is possible to adjust the length of the core piece, furthermore, the length of the entire length of the bar core 2 in the other sections, and it becomes easy to let make the bar antenna 1 responsive to the desired frequency.

In the modification example 2 of FIG. 5B, the bar core 2 is configured by four core pieces where a fourth core piece 2*d* is added further to the third core piece 2*c* of the modification example 1. The core piece 2*b* being located in the second position from the one end side (left end side in FIG. 5B) has a length longer than the first core piece 2*a*, the third core piece 2*c* and the fourth core piece 2*d* in the both sides, and is covered with the bobbin 3 on which the winding 4 is wound.

In the modification example 3 of FIG. 5C, the bar core 2 is configured by five core pieces where a fifth core piece 2*e* is added further to the fourth core piece 2*d* of the modification example 2. The core piece 2*b* being located in the second position from the one end side (left end side in FIG. 5C) has a length longer than the first core piece 2*a*, the third core piece 2*c*, the fourth core piece 2*d*, and the fifth core piece 2*e* in the both sides, and is covered with the bobbin 3 on which the winding 4 is wound.

In the modification example 4 of FIG. 5D, as in the modification example 3, the bar core 2 is configured by the five core pieces of the first core piece 2*a* to the fifth core piece 2*e*. The different point from the modification example 3 is that the third core piece 2*c* being located in the center has a length longer than the first core piece 2*a*, the second core piece 2*b*, the fourth core piece 2*d*, and the fifth core piece 2*e* in the both sides, and is covered with the bobbin 3 on which the winding 4 is wound.

Figure 6A:
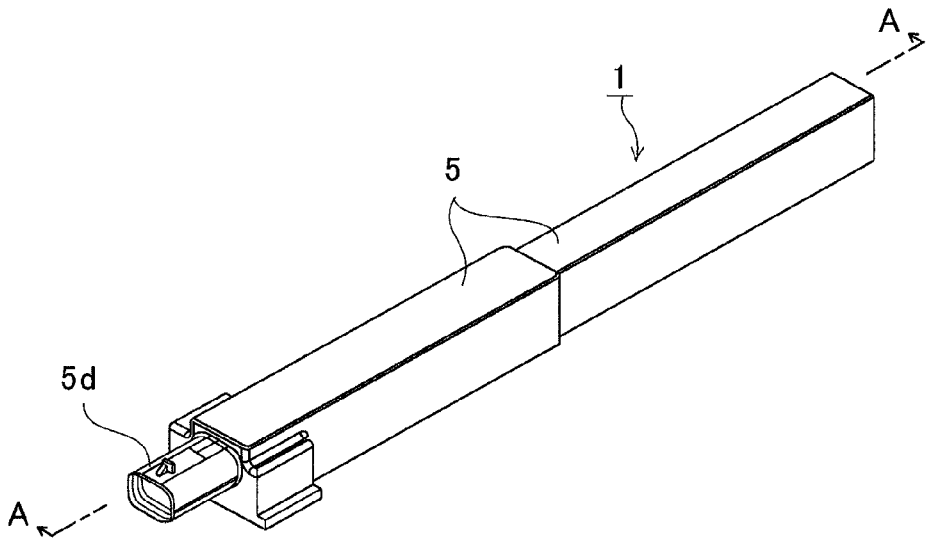
FIG. 6A is a perspective view representing an outer view.
Figure 6B:
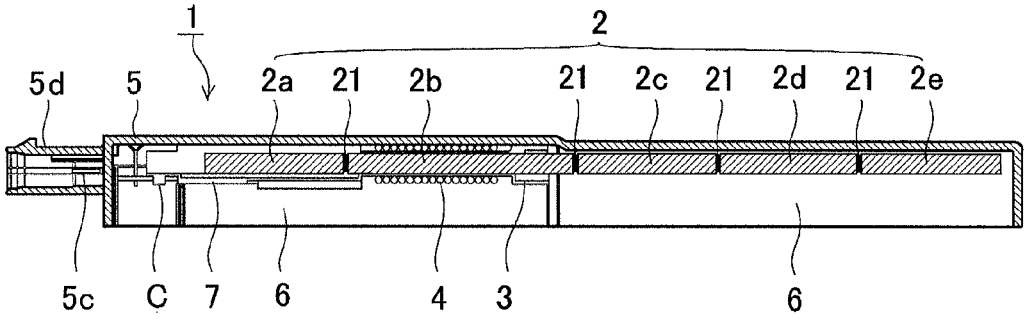
FIG. 6B is a cross-sectional view as seen from a side.

As described above, in the fourth embodiment, as in the modification example 1 to the modification example 4, by increasing the number of the core pieces sequentially, it is possible to achieve the bar antenna 1 to a desired performance. FIG. 6 is a diagram tangibly illustrating the bar antenna 1 being configured using the modification example 3 of the fourth embodiment, and FIG. 6A is a perspective view illustrating an outer view and FIG. 6B is a cross-sectional view taken along the line A-A of FIG. 6A. Here, in the modification example 3, an example is given in which the printed circuit board 7 is provided to the first core piece 2*a* in the one end side (left end side in FIG. 6B). The bar antenna 1 is attached to the inside of a trunk, the inside of a door mirror, and the like of an automobile, through the mounting portion (not shown in Figs.) of one or more being provided in the lower portion of the case 5. The inside of the case 5 is filled with the potting material 6.

The second core piece 2*b* is covered with the bobbin 3 on which the winding 4 is wound. The second core piece 2*b* is disposed so that the left end thereof is located to protrude a little from the left end of the section of the winding 4, and the right end thereof is located to protrude a little from the right end of the bobbin 3. In other words, the connection portion 21 of the first core piece 2*a* and the second core piece 2*b*, and the connection portion 21 of the second core piece 2*b* and the third core piece 2*c* are configured so as not to be located in the section where the winding 4 is wound. Here, the case 5 is narrowed in the right end side of the bobbin so as to be thinner by one size. This is, since the core pieces 2*c* to 2*e* are not covered with the bobbin, for reducing the amount of the potting material by narrowing the gaps in the case and thereby reducing the cost.

EXAMPLES

Drop Impact Test

On the embodiment 1 to the embodiment 3 described above, in order to verify the effect, the following drop impact test has been carried out. The summary of the test is as follows.

(1) Classification of Test Specimen

Conventional Example

There is represented a conventional specification, and is provided with a short bobbin accommodating a single bar core and a portion of a bar core.

Example 1

There is represented an example of the first embodiment, and is provided with a short bobbin accommodating the first core piece only.

Example 2

There is represented an example of the second embodiment, and is provided with a long bobbin accommodating the first core piece and the second core piece.

Example 3

There is represented an example of the third embodiment, and the winding of Example 1 is changed to a double layer winding and the winding width is about one half of Example 1.

(2) Manufacturing condition of test specimen

Cross-section of core: all specimens 7 mm×3.2 mm

Length of core:

Single bar core 67 mm first core piece 41 mm second core piece 25 mm

Length of bobbin;

Long bobbin 71 mm

Short bobbin 40 mm

Adhesion of first core piece and second core piece: Epoxy adhesive

Potting material: Urethane resin (JIS (Japanese Industrial Standards) Hardness A21)

(3) Contents of Test

A test specimen having adjusted to a predetermined resonance frequency $f_0$ is dropped on a concrete floor surface in six directions of up and down, forth and back, and left and right, from a height of 100 cm, and then the resonance frequency $f_1$ is measured and the variation amount of the resonance frequency $(f_1-f_0)/f_0$ is calculated. This as one time, repeat 15 times, the variation amount of the resonance frequency was calculated every times. If the variation amount of the resonance frequency exceeds an allowable range of 0.6%, the test will be over. The results of the above test are illustrated in the graph of FIG. 7.

Figure 7:
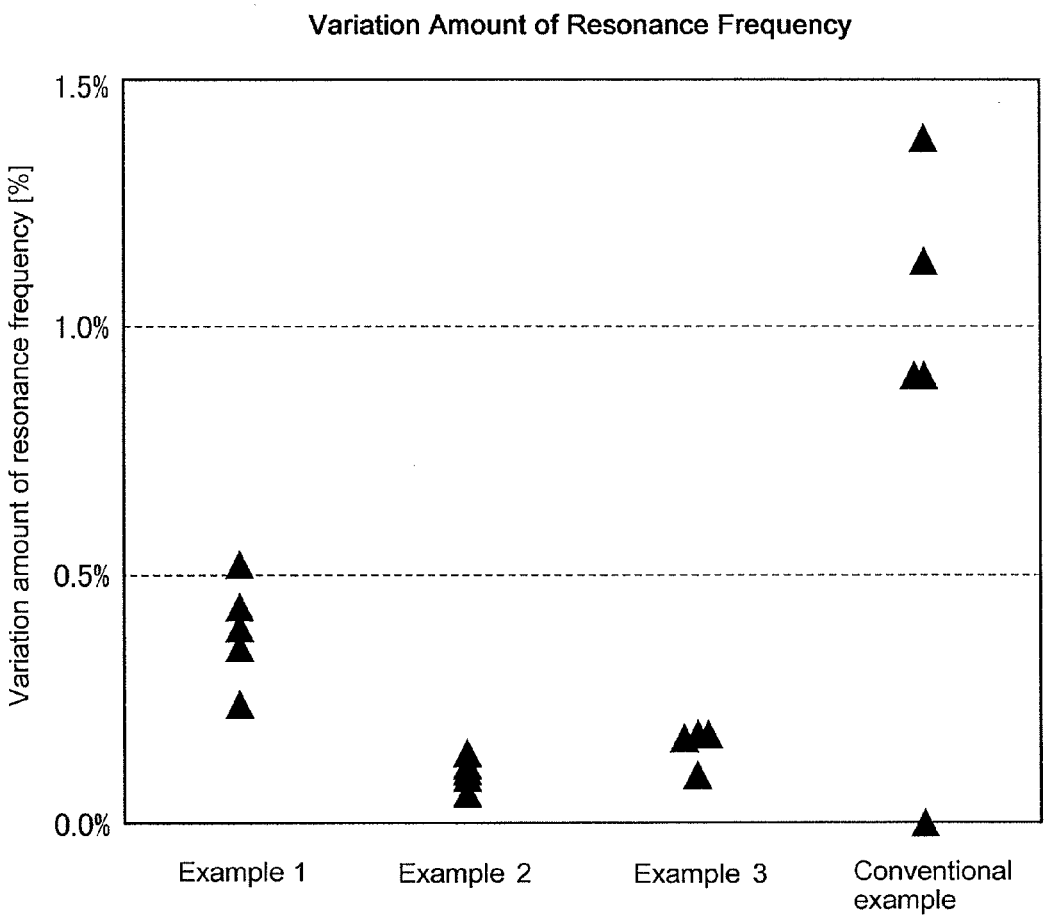
FIG. 7 is a graph illustrating the frequency change amount due to a drop impact test of the first to third embodiments of the present invention and the prior art.
Figure 8:
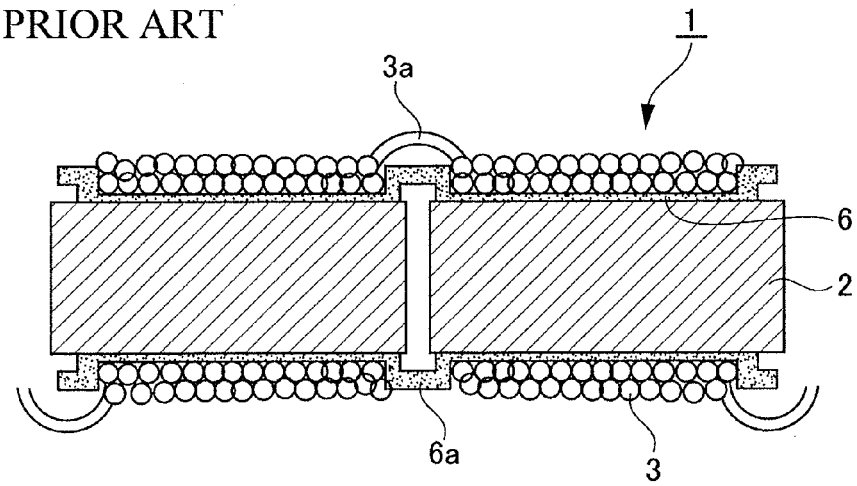
FIG. 8 PRIOR ART
FIG. 8 is a diagram illustrating an example of a conventional bar antenna, corresponding to FIG. 1 of the Patent Literature 1.
Figure 9:
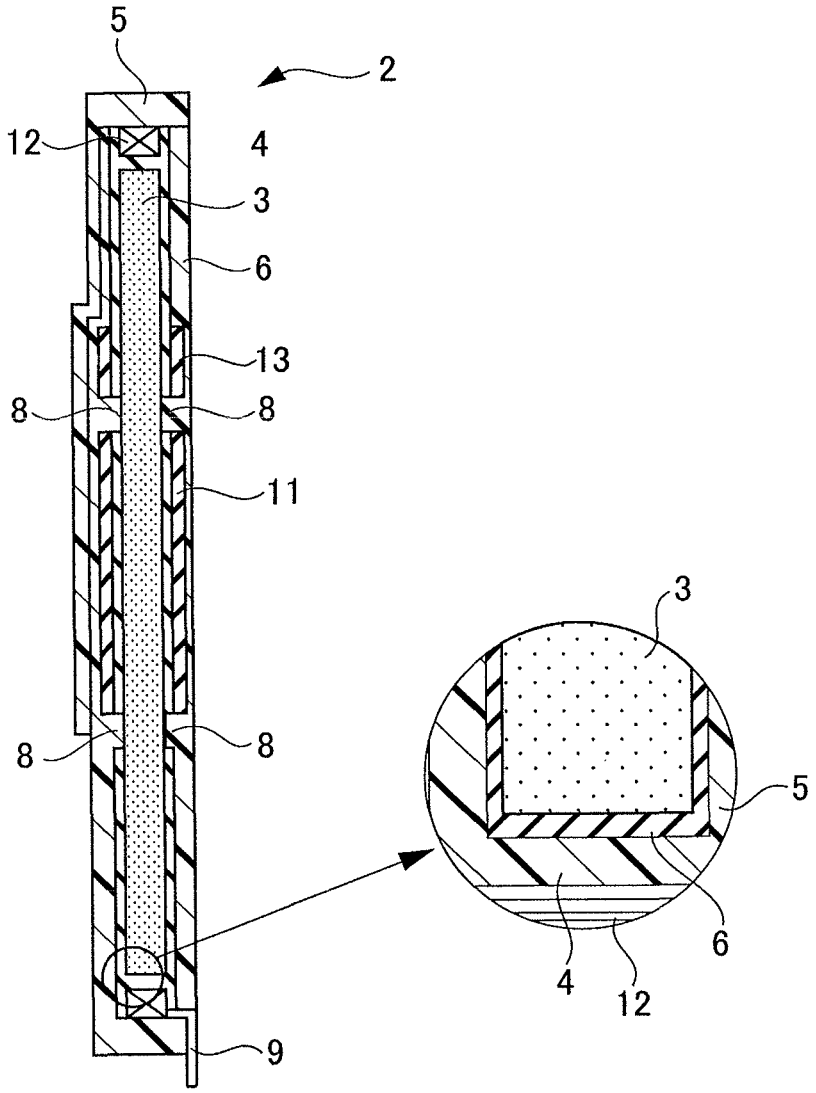
FIG. 9 is a diagram illustrating another example of a conventional bar antenna, corresponding to FIG. 1 of the Patent Literature 2.

From the results of FIG. 7, in the Conventional Example, in four of the five test specimens within the five times, the core pieces broke, and the variation amount of the resonance frequency exceeded 0.6%. On the other hand, in Example 1 and Example 2, the core piece did not break and the variation amount of the resonance frequency was 0.6% or less. Therefore, it is considered that by dividing the bar core 2 which was a single piece conventionally into the first core piece 2*a* and the second core piece 2*b*, the bending strength of each of the core pieces was improved.

It is considered that the variation amount of the resonance frequency of 0.6% or less is caused by a slight change of the distance between the first core piece 2*a* and the second core piece 2*b* due to the drop impact, but since the surroundings of the first core piece 2*a* and the second core piece 2*b* are filled with the potting material, the drop is mitigated by the flexibility of the potting material, and the first core piece 2*a* and the second core piece 2*b* are going to be returned to each original position, and so, after the drop impact test, the variation amount of the resonance frequency falls in the allowable range of 0.6% or less.

This slight variation amount of the resonance frequency was smaller in Example 1 having the long bobbin than in Example 2 having the short bobbin. It is considered that in Example 2, since the first core piece 2*a* and the second core piece 2*b* were contained in the long bobbin, the position changes of the first core piece 2*a* and the second core piece 2*b* were kept to minimum.

Further, in the results of FIG. 7, the variation amount of the resonance frequency change is smaller in Example 3, than the results in Example 1. It is considered that by taking the distance from the end of the core piece to the end of the winding as long as possible by forming the winding in the multi-layer winding, the variation amount of the resonance frequency to the position changes between the first core piece 2*a* and the second core piece 2*b* could be reduced.

The present invention is not limited to each of the embodiments and each of Examples described above. For example, the ratio of the length of the core piece being covered with the bobbin and the length of the other core piece, the hardness of the potting material, the mounting position of the printed circuit board, and the like can be modified appropriately, and such modifications are also included in the technical scope of the present invention.

REFERENCE SIGNS LIST

1 . . . bar antenna; 2 . . . bar core; 2*a* . . . first core piece; 2*b* . . . second core piece; 2*c* . . . third core piece; 2*d* . . . fourth core piece; 2*e* . . . fifth core piece; 21 . . . connection portion; 3, 32, 33 . . . bobbin; 4, 43 . . . winding; 5 . . . case; 6 . . . potting material; 7 . . . printed circuit board; C . . . capacitor; V . . . vehicle; W . . . winding width

The invention claimed is:

1. A bar antenna comprising:

a bar core comprising at least two core pieces, the at least two core pieces comprising a first core piece and a second core piece arranged and connected via a connection portion in series, and the second core piece having a length less than a length of the first core piece;

a bobbin disposed over a substantially entire periphery of the bar core;

a winding wound on only a portion of the bobbin where the first core piece is arranged; and a case having the bar core and the bobbin disposed therein, wherein the bar core and the bobbin are sealed by filling in the case with a potting material, and wherein the bar core is bendable with respect to a predetermined external force at the connection portion of the at least two core pieces.

2. The bar antenna according to claim 1, wherein the bobbin is formed of inflexible resin.

3. The bar antenna according to claim 2, wherein the inflexible resin is polybutylene terephthalate (PBT).

4. A bar antenna comprising:

a bar core comprising at least two core pieces, the at least two core pieces comprising a first core piece and a second core piece arranged and connected via a connection portion in series, and the second core piece having a length less than a length of the first core piece;

a bobbin disposed over only a periphery of the first core piece;

a winding wound on an entire periphery of the bobbin; and a case having the bar core and the bobbin disposed therein, wherein the bar core and the bobbin are sealed by filling in the case with a potting material, and wherein the bar core is bendable with respect to a predetermined external force at the connection portion of the at least two core pieces.

5. The bar antenna according to claim 4, wherein the potting material is a flexible, electrically insulating material.

6. The bar antenna according to claim 4, wherein the winding on the bobbin is a multilayered winding.

7. The bar antenna according to claim 4, wherein the bar core further comprises:

at least one additional core piece which has a length less than the length of the second core piece, wherein the first core piece, the second core piece, and the at least one additional core piece are arranged and connected in series.

8. The bar antenna according to claim 4, wherein the second core piece is arranged in an area of the bar core other than both ends of the bar core.

9. The bar antenna according to claim 4, wherein the bobbin is formed of inflexible resin.

10. The bar antenna according to claim 9, wherein the inflexible resin is polybutylene terephthalate (PBT).

* * * * *